US006684746B2

(12) United States Patent
Hilliard et al.

(10) Patent No.: US 6,684,746 B2
(45) **Date of Patent: *Feb. 3, 2004**

(54) VARIABLE-LENGTH CUT-OFF FOLDER AND METHOD

(75) Inventors: Michael William Hilliard, Somersworth, NH (US); David Clarke Pollock, Somersworth, NH (US); Charles Francis Svenson, Laconia, NH (US); Roland Thomas Palmatier, Durham, NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/452,975

(22) Filed: Dec. 2, 1999

(65) Prior Publication Data

US 2003/0115997 A1 Jun. 26, 2003

(51) Int. Cl.[7] ..... B26D 1/56
(52) U.S. Cl. ..... 83/325; 83/326
(58) Field of Search ..... 83/325, 326, 322, 83/323, 324, 107, 327, 328, 409, 409.1; 270/30.08, 30.09, 52.17; 493/194, 199, 357

(56) References Cited

U.S. PATENT DOCUMENTS

| | | | | | |
|---|---|---|---|---|---|
| 1,355,449 | A | * | 10/1920 | Campbell | 83/661 |
| 1,478,998 | A | * | 1/1924 | Howard et al. | 83/325 |
| 1,939,196 | A | | 12/1933 | Barber | 164/68 |
| 2,262,988 | A | * | 11/1941 | Brown et al. | 83/326 |
| 2,512,204 | A | * | 6/1950 | Gould | 83/326 |
| 3,054,315 | A | * | 9/1962 | Sarka | 83/323 |
| 3,122,467 | A | * | 2/1964 | Hannon | 83/326 |
| 3,192,096 | A | * | 6/1965 | Rhine | 83/614 |
| 3,247,744 | A | * | 4/1966 | Huck et al. | 83/325 |
| 3,275,118 | A | * | 9/1966 | McCain et al. | 83/423 |
| 3,300,365 | A | * | 1/1967 | Roos | 83/326 |
| 3,623,386 | A | * | 11/1971 | Bach et al. | 83/326 |
| 3,858,476 | A | * | 1/1975 | DeLigt | 493/357 |
| 3,947,013 | A | | 3/1976 | Nystrand | 270/79 |
| 4,893,534 | A | * | 1/1990 | Kobler | 83/346 |
| 5,000,433 | A | | 3/1991 | Prum et al. | 270/49 |
| 5,624,369 | A | * | 4/1997 | Bidlack et al. | 493/342 |
| 5,740,900 | A | | 4/1998 | Cote et al. | 198/436 |
| 5,865,082 | A | | 2/1999 | Cote et al. | 83/155 |
| 6,537,188 | B1 | * | 3/2003 | Cote et al. | 493/194 |

* cited by examiner

*Primary Examiner*—Stephen Choi
(74) *Attorney, Agent, or Firm*—Davidson, Davidson & Kappel, LLC

(57) ABSTRACT

A device for cutting a web of material, the web having a web velocity and moving in a web direction. The device includes a plurality of linearly movable cutting elements capable of moving in the same direction as the web direction for cutting the web into signatures, and a plurality of gripper elements interacting with the cutting elements. A method for cutting a web includes the steps of linearly moving a plurality of cutting elements within a signature formation area, the web also moving within the signature formation area, the cutting elements and the web moving in the same direction; cutting the web with the plurality of cutting elements so as to form signatures; gripping the signatures; and varying a length of the signatures by varying a spacing between cutting elements in the signature formation area.

13 Claims, 5 Drawing Sheets

VARIABLE-LENGTH CUT-OFF FOLDER AND METHOD

BACKGROUND OF THE INVENTION

1. Field of the Invention

The present invention relates generally to web printing presses and more particularly to a folder for a web printing press as well as to a method for cutting a web and diverting the resultant signatures into two streams.

2. Background Information

Web printing presses print a continuous web of material, such as paper. The continuous web then is cut in a cutting unit so as to form signatures which can then be folded in a folder or arranged in different manners. In order to arrange signatures in a desired fashion or to permit desired folds, the signatures often may be diverted into two streams, for example, and also may be decelerated. In order to decrease the signature length, it is often necessary to increase the angular velocity ratio between the folder and the printing units of the printing press. As a result, the velocity of the signature has to increase after it is cut from the web, which is counterproductive to downstream transport functions. Signatures thus often must be decelerated in a deceleration device. However, these deceleration devices often damage the signatures, e.g. through dog-earing, or jam the folder because the transfer from or to the deceleration device fails.

U.S. Pat. No. 5,865,082 discloses an apparatus for forming signatures from a web of material. A pair of rotating cylinders cuts the web to form signatures. A plurality of conveying elements traveling in two loops holds the web as the web passes between the cutting cylinders. The conveying elements thus also hold the signatures as they are formed. This device has the disadvantage that the cutting cylinders merely rotate so that the angular velocity ratio of the folder must be increased to decrease signature length.

U.S. Pat. No. 5,740,900 discloses an apparatus for splitting a product stream into an A stream and a B stream. The signatures are gripped by grippers, and alternating grippers rotate to split the product stream. No cutting device is discussed.

BRIEF SUMMARY OF THE INVENTION

An object of the present invention is to provide a reliable device and method for cutting a web into signatures, while permitting for variable-length formats. An alternate or additional object of the present invention is to reliably split the signatures into two streams.

The present invention provides a device for cutting a web of material. The web has a web velocity and moving in a web direction. The device includes a plurality of linearly movable cutting elements capable of moving in the same direction as the web direction for cutting the web into signatures and a plurality of gripper elements interacting with the cutting elements. Since the cutting elements are linearly movable in the web direction, the spacing between the elements can be used to set the signature length. The velocity of the web in the folder advantageously need not be altered in order to change the signature length.

Each gripper element may include a gripper which can then grip the signature and be decelerated, if desired. Each cutting element may include a knife, and each gripper each gripper element may include an anvil against which the knife may cut the web. Each gripper element may also include a retractable sideways-extending pin. The device may further include a deceleration disk interacting with the pin, so that the gripper elements are supported and decelerated by the deceleration disk.

The device also may include a positive drive mechanism for moving the cutting elements in the web direction.

The present invention also provides a device for cutting a web of material including a plurality of linearly movable first cutting elements for moving along a first path, a plurality of linearly movable first gripping elements for moving along the first path, a plurality of linearly movable second cutting elements for moving along a second path and interacting with the first gripping elements, and a plurality of second gripper elements for moving along the second path and interacting with the first cutting elements. The web passes between the first path and the second path in a signature formation area.

Preferably, the first cutting elements and the first gripping elements are arranged in an alternating fashion along the first path. After the signature formation area, the first gripping elements move in a direction opposite the second gripping elements so that an A/B signature split may be achieved.

The first path and the second paths preferably are closed loops.

The cutting elements preferably include a double-bladed laterally-traversing rotary-type knife, which cuts a strip of material between each signatures. This type of knife aids in print quality, since with a single blade knife if there are any imperfections in the cut or the printing, the color from one signature may appear at the edge of the next signature. The strip of material created by the double-bladed knife can remove these imperfections. The device may include a blower and/or suction device to remove the strip of material from the anvil, where the strip becomes attached after cutting.

The present invention also provides a method for cutting a web. A plurality of cutting elements are moved linearly within a signature formation area, with the cutting elements and the web moving in the same direction. As defined herein, "linearly moving" or "linearly movable" means that the elements can move translationally, as opposed to rotationally as with conventional cutting cylinders. The web is cut with the plurality of cutting elements so as to form signatures. The signature length is varied based on a spacing between the cutting elements within the signature formation area.

The method may further comprise diverting the signatures in an alternating fashion to define a first stream and a second stream of the signatures.

The cutting elements may be moved at the web velocity within the signature formation area.

The method further may include decelerating the signatures after the signatures exit the signature formation area and accelerating the cutting elements before the cutting elements enter the signature formation area.

The method also preferably includes cutting a strip of material between each signature. This cutting step may be performed, for example, by a laterally traversing double-bladed rotary type knife. The strip may then be removed, for example, by a blower or suction device. By eliminating a strip between the signatures, print quality of at the edges of the signatures can be improved.

BRIEF DESCRIPTION OF THE DRAWINGS

One preferred embodiment of the present invention is described below by reference to the following drawings, in which.

DETAILED DESCRIPTION

Figure 1:
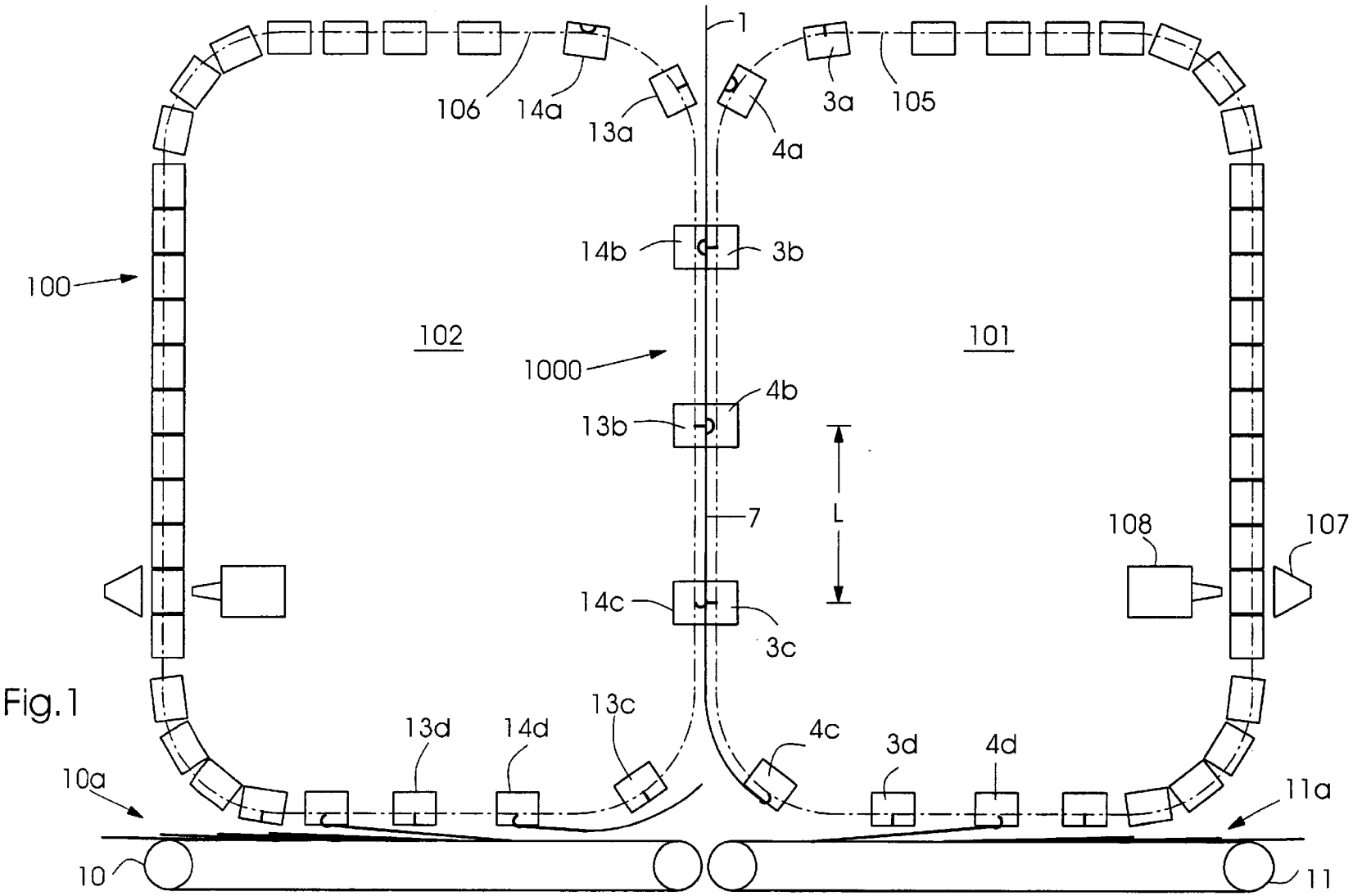
FIG. 1 shows a schematized side view of a folder according to the present invention.

FIG. 1 shows a folder 100 having a first loop 101 and a second loop 102. First loop 101 has a path 105 along which run a plurality of cutting elements 3*a*, 3*b*, 3*c*, 3*d*, etc, as well as a plurality of gripping elements 4*a*, 4*b*, 4*c*, 4*d*, etc. The cutting elements and gripping elements are arranged in alternating fashion. Second loop 102 also has a plurality of cutting elements 13*a*, 13*b*, 13*c*, 13*d*, etc. and a plurality of gripping elements 14*a*, 14*b*, 14*c*,14*d*, etc, running on a path 106.

A web 1 of material such as paper enters a gap formed between loop 101 and loop 102. "Web" as defined herein may include one or more ribbons of material, which may or may not already be longitudinally folded. Each cutting element may include a bar and a knife. Each gripper element may include a gripper and an anvil. Web 1 is thus gripped between the bar of cutting element 3*b* and the anvil of gripping element 14*b* as the cutting element 3*b* along path 105 and gripping element 14*b* along path 106 come together. The cutting elements and gripping elements can move at the same velocity as web 1 on this section of tracks 101 and 102, shown in FIG. 1 as signature formation area 1000.

As the web moves through signature formation area 1000, it is gripped between the bar and the anvil and the knife of the cutting element cuts web 1, so as to form a plurality of signatures. For example, a knife in cutting element 13*b* cuts the web 1 against the anvil of gripping element 4*b*. Thus a signature 7 can be formed. A front edge of the signature, cut by cutting element 3*c*, is gripped by the gripper of gripping element 14*c*.

Since the gripping elements and cutting elements of the loops 101 and 102 alternate, as the gripping elements move out of the cutting area, the signatures are split into two streams, such that an A stream 17 of signatures and a B stream 18 of signatures are formed.. These signatures may then be released by the gripping elements onto conveying mechanisms 10 and 11. The A and B streams may be decelerated by the gripping elements as they move out of the signature formation area, so that the streams have a velocity of about 20 percent of the web velocity.

Since the cutting elements and gripping elements may be moved into the signature formation area in a controlled manner, the length of the signatures may be controlled by controlling the distance between consecutive pairs of cutting elements and gripping elements within the signature formation area. Thus the present invention provides for a variable signature length (cut-to-cut distance), shown for example as variable length L in FIG. 1.

Figure 2:
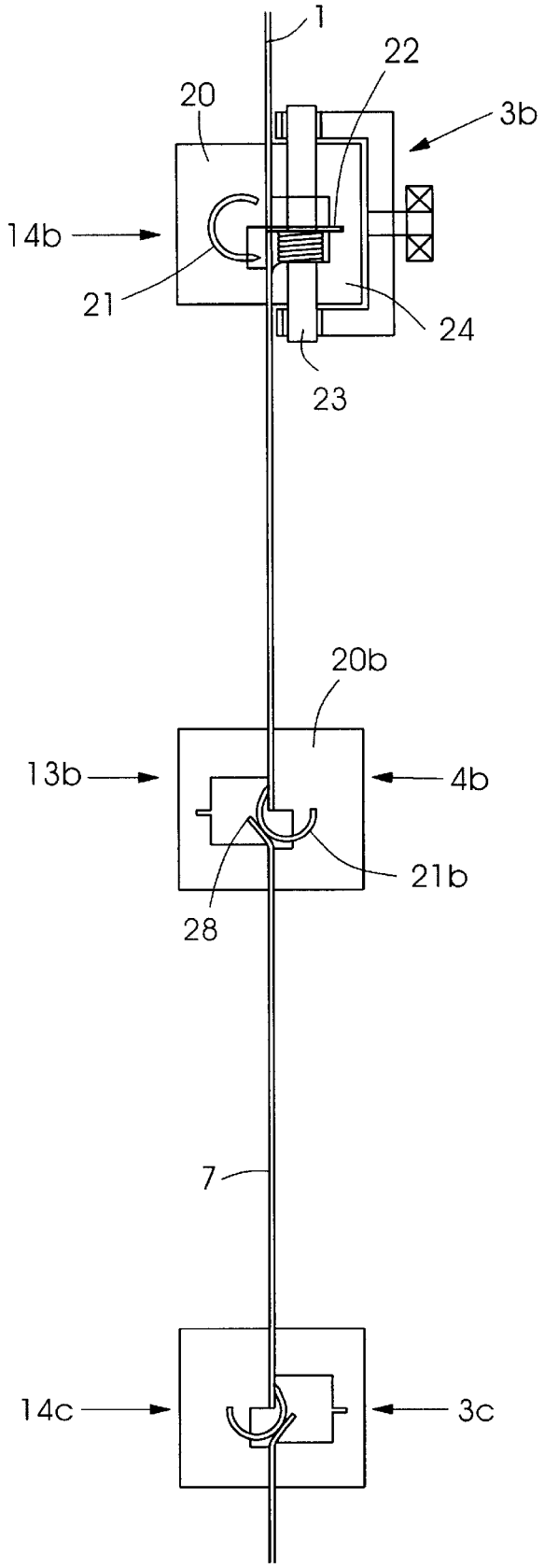
FIG. 2 shows the cutting and gripping elements of the folder of FIG. 1 in more detail.

FIG. 2 shows signature formation area 1000 in more detail. Gripper element 14*b* includes an anvil 20 and a rotatable gripper 21. Cutting element 3*b* has a knife 22, supported for example on a support 23. Knife 22 thus may cut the web as knife 22 comes against anvil 20. Alternatively, web 1 may be first be held between anvil 20 and a bar 24 of cutting element 3*b* and then knife 22 moved to cut web 1. The cut lead edge of the web can then be gripped by the gripper, which is rotated to grasp the lead edge as shown with next gripping element 4*b*, which has an engaged gripper 21. The knife of cutting element 13*b* is not shown in order to aid clarity, but is similar to the knife of cutting element 3*b*.

Gripper 21 pins the lead edge along its entire length against anvil 20*b*, thereby preventing any damage to the lead edge, such as "dog-earring." Trail edge 28 of the preceding signature is also nudged out of the way by gripper 21. Unlike most pinless folders, this arrangement obviates the need to accelerate cut signatures to create a head-to-tail space. This acceleration is counter-productive to the ultimate goal of decelerating the signatures.

The knife may be a laterally-traversing rotary-type knife or a shear-type knife.

Figure 5:
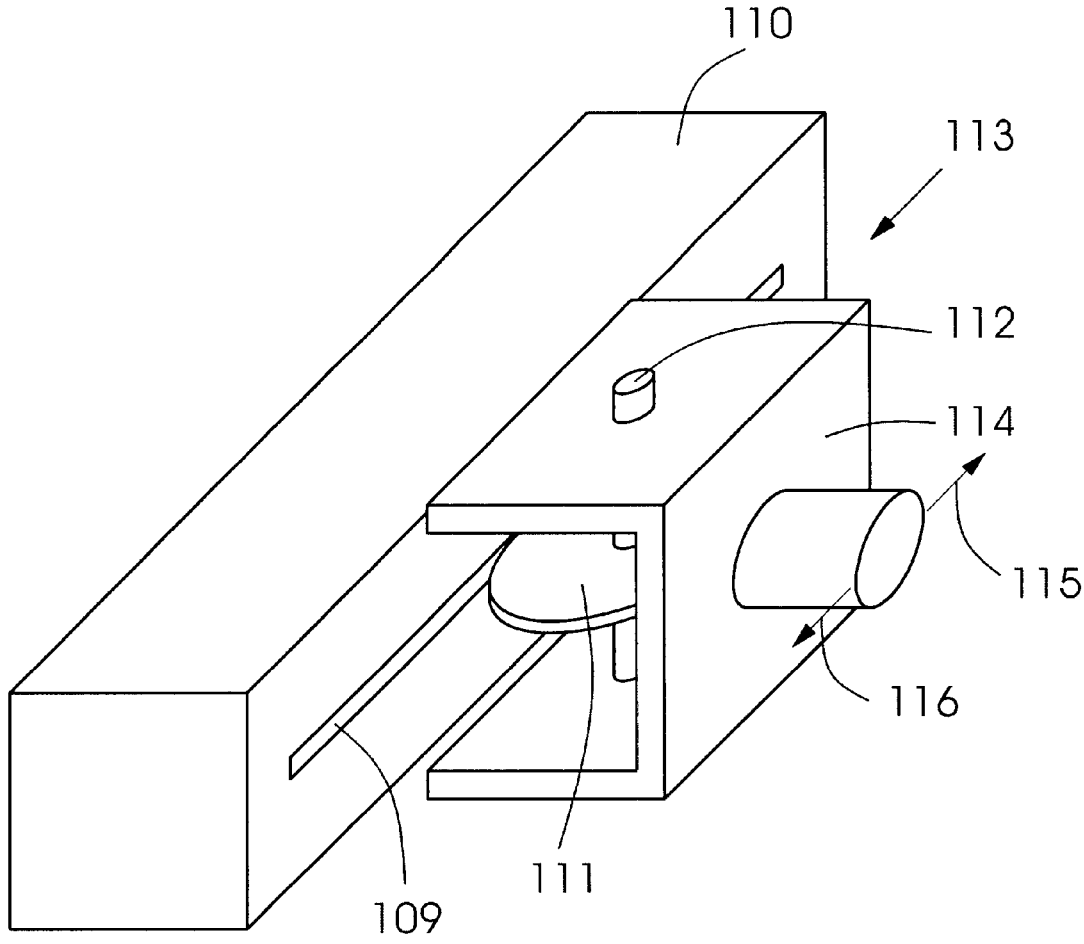
FIG. 5 shows a double-bladed laterally-traversing rotary-type knife according to one further embodiment of the present invention.

FIG. 5 shows a preferred cutting element 113 for use with the device of FIGS. 1 and 2. Cutting element 113 has a frame 114, which can be moved both in the web direction and traverse to the web direction as indicated by arrows 115 and 116, through for example a motor and a toothed gear. Frame 114 supports a rotating knife axle 112 on which is a knife 111. Knife 111 has two blades spaced slightly apart, for example, 2 mm or less.

The cutting process with this knife thus occurs as follows. The web is first clamped between an anvil 110 and a bar (not shown) extending through frame 114 above and/or below knife 111 so as to be held tightly. As the web travels through the signature formation area, the frame and double-edged knife 111 move in direction 115 or 116 to create a pair of parallel cuts through the web. A very thin strip of trim waste lodges in anvil slot 109 of anvil 110.

This small strip of waste later may be removed from the anvil by air jets 108 and vacuum system 107, as shown in FIG. 1.

Figure 3:
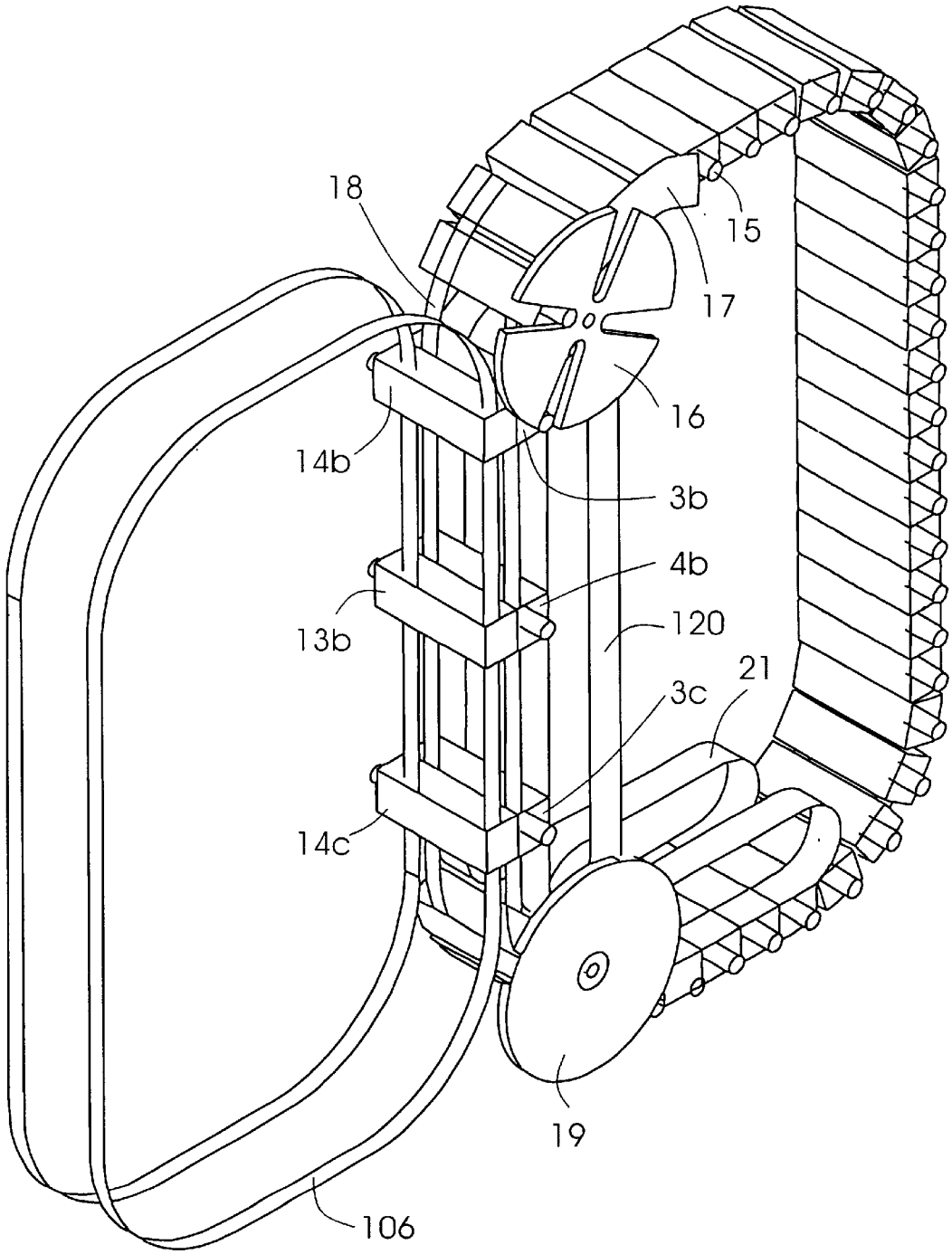
FIG. 3 shows a perspective schematized view of the folder of FIG. 1.

FIG. 3 demonstrates how the cutting element/gripping element pairs are controlled so as to accelerate as they enter the signature formation area, and decelerate as they exit the signature formation area. Each cutting element and gripping element has a retractable pin 15. As a queue of cutting and gripping elements passes a ramp 17, pins 15 are pushed back into the elements. A spring in the elements pushes the pin back out once the element clears the ramp, thus engaging a slot of an indexing disk 16. The motion of the elements is then controlled by disk 16 and a guide rail 18. As disk 16 rotates clockwise, the constraint imparted by rail 18 guides pin 15 towards the outer circumference of disk 16. Since the effective radius increases, the elements accelerate. As the pins pass out of the slots in disk 16, the motion of the elements is controlled by a positive drive mechanism 120, for example a belt drive. For path 106, similar disks to disk 16 and 19 are provided, as can be a similar drive mechanism to drive mechanism 120.

Drive mechanism 120 controls the clamping bar velocity at the speed of the web 1. The rotational velocity of disk 16 relative to the web speed sets the pitch distance between successive pairs of gripping element/cutting element pairs, which defines the length of the cut signatures. By varying the relative speed of the disk to the web speed (press speed) an operator can select the cut-to-cut length of the signatures.

Drive mechanism 120 then passes control of the clamping bar to a deceleration disk 19. Deceleration disk 19 is similar to indexing disk 16, except that disk 19 is modified to dislodge pins 15 as the pins approach the minimum radius of the slot in disk 19. The gripping elements are decelerated to the desired signature delivery speed because their motion is controlled by guide rail 18, which guides the gripping elements such that their pin 15 moves progressively towards the center of deceleration disk 19.

Figure 4:
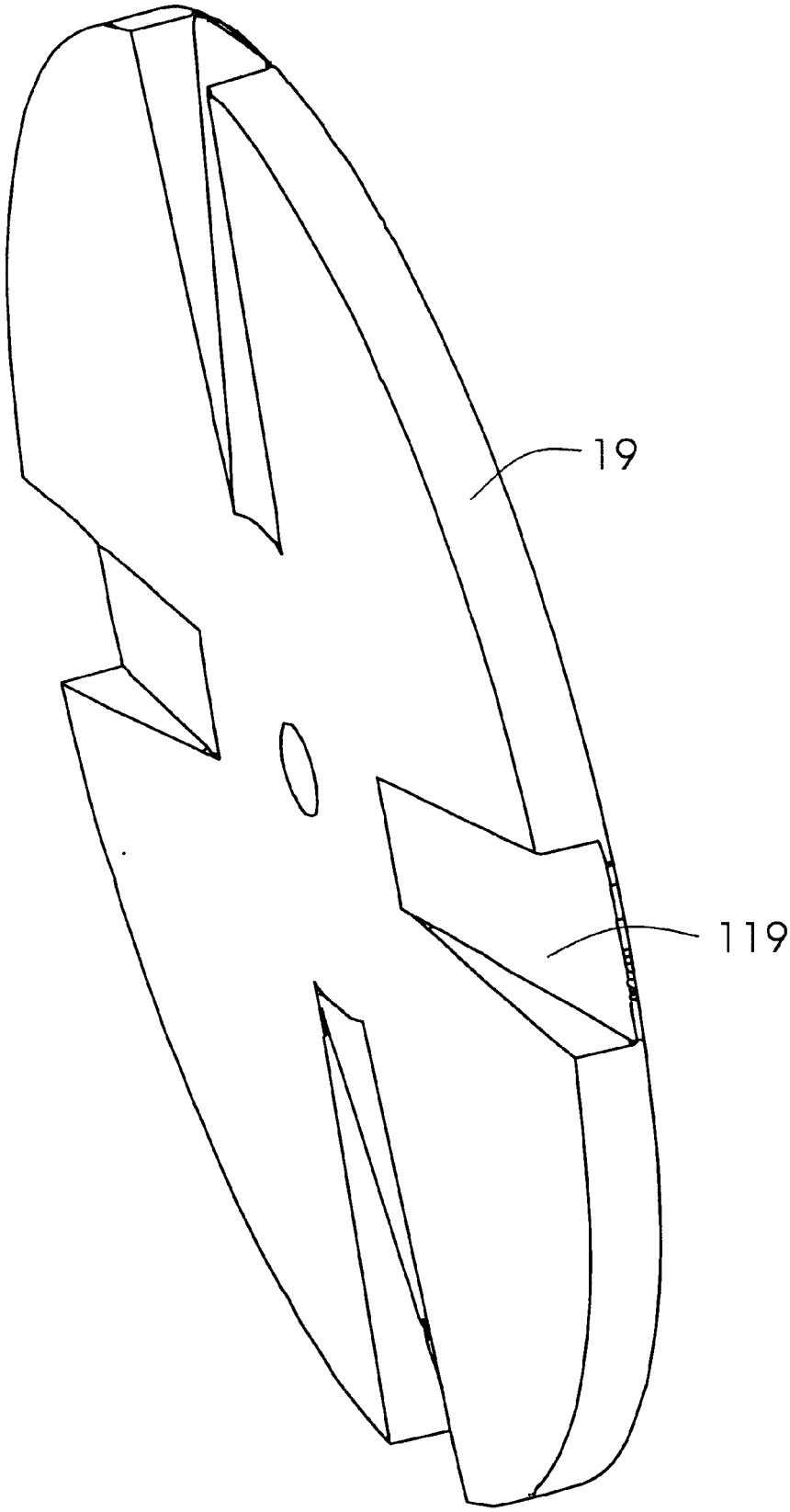
FIG. 4 shows a detailed view of the deceleration disk shown in FIG. 3.

FIG. 4 is an more detailed view of the deceleration disk 19 shown in FIG. 3. FIG. 4 shows how slots 119 taper toward the center of disk 19 so that as the pin moves toward the center of disk 19 under control of rail 18, the pin is pushed inward into the element. As pin 15 is dislodged from deceleration disk 19, control of the clamping bar is transferred to a further drive mechanism 21, which runs at the queuing speed.

Linear motor technology may be used an alternative to the mechanical drive illustrated in FIG. 3. In this case guide rails which can form the paths 105 and 106 in FIG. 1 become the stator of the linear motor. These guide rails have electrical windings. The spacing of the windings or the current within the windings can vary to provide for acceleration and deceleration of the cutting and gripping elements. Thus design of the windings in the stator and controlling the frequency of the current applied to the windings defines and controls the motion and the spacing of the gripping and cutting elements, which are the rotors or reaction plates of the linear motor. The gripping and cutting elements thus have magnets which are driven by the current in the electrical windings.

Press speed signal and operator inputs of desired cut-to-cut length are linked to the linear motor's controller, for example through a PLC. Depending on the type of linear motor used precise position control of the clamping bars may also require using linear encoder feedback.

"Gripper element" as defined herein need not include a gripper, but may merely function as an anvil for the respective cutting element.

What is claimed is:

1. A device for cutting a web of material, the web having a wab velocity and moving in a web direction, the device comprising:

a plurality of linearly movable cutting elements capable of moving in the same direction as the web direction for cutting the web into signatures in a signature formation area, and a plurality of gripper elements, the gripper elements being located opposite the cutting elements as the web is between the cutting elements and the gripper elements, the gripper elements gripping the signatures at a lead edge and transporting the signatures away from the cutting elements after the signature formation area.

2. The device as recited in claim 1 wherein each gripper element includes a gripper.

3. The device as recited in claim 1 wherein each cutting element includes a knife.

4. The device as recited in claim 1 wherein each gripper element includes an anvil.

5. The device as recited in claim 1 wherein each cutting element includes a double-bladed laterally-traversing knife.

6. The device as recited in claim 1 wherein each gripper element includes a pin and further including a deceleration disk interacting with the pin.

7. The device as recited in claim 1 further comprising a positive drive mechanism for moving the cutting elements in the web direction.

8. A device for cutting a web of material comprising:

a plurality of linearly movable first cutting elements for moving along a first path;

a plurality of linearly movable first gripping elements for moving along the first path;

a plurality of linearly movable second cutting elements for moving along a second path, the web passing between the first path and the second path in a signature formation area, the first gripper elements being located opposite the second cutting elements as the web is between the second cutting elements and the first gripper elements, the first gripper elements gripping the signatures for further transport after the signature formation area; and a plurality of second gripper elements for moving along the second path, the second gripper elements being located opposite the first cutting elements as the web is between the first cutting elements and the second gripper elements, the second gripper elements gripping the signatures for further transport after the signature formation area.

9. The device as recited in claim 8 wherein the first cutting elements and the first gripping elements are arranged in an alternating fashion along the first path.

10. The device as recited in claim 9 wherein the first gripping elements move in a direction opposite the second gripping elements after the signature formation area.

11. The device as recited in claim 8 wherein the first path is a loop.

12. The device as recited in claim 8 wherein each gripper element includes a gripper.

13. The device as recited in claim 8 wherein each cutting element includes a double-bladed laterally-traversing knife.

* * * * *